US005393389A

United States Patent [19]

Herrmann et al.

[11] Patent Number: 5,393,389

[45] Date of Patent: Feb. 28, 1995

[54] ELECTROLYTIC PROCESS FOR OBTAINING HIGH PURITY PLATINUM FROM CONTAMINATED PLATINUM

[75] Inventors: Sigrid Herrmann; Uwe Landau, both of Berlin, Germany

[73] Assignee: Schott Glaswerke, Mainz, Germany

[21] Appl. No.: 170,422

[22] Filed: Dec. 20, 1993

[30] Foreign Application Priority Data

Dec. 18, 1992 [DE] Germany ..... 4243699

[51] Int. Cl.[6] ..... C25C 1/20

[52] U.S. Cl. ..... 204/109; 204/111; 204/126; 204/140

[58] Field of Search ..... 204/109, 111, 126, 140; 205/255, 264

[56] References Cited

U.S. PATENT DOCUMENTS

| | | | |
|---|---|---|---|
| 3,891,741 | 6/1975 | Carlin et al. | 204/105 R |
| 4,382,845 | 5/1983 | Hubred | 204/111 |
| 4,775,452 | 10/1988 | Kuninaga | 204/146 |

FOREIGN PATENT DOCUMENTS

| | | |
|---|---|---|
| 0253783 | 1/1988 | European Pat. Off. . |
| 594408 | 3/1934 | Germany . |
| 02038536 | 2/1990 | Japan . |
| 157785 | 1/1921 | United Kingdom . |

OTHER PUBLICATIONS

Gmelin Au, Syst. No. 62, 1949, pp. 338–341.

*Primary Examiner*—John Niebling
*Assistant Examiner*—Brendan Mee
*Attorney, Agent, or Firm*—Michael J. Striker

[57] ABSTRACT

The electrolytic process for obtaining platinum of high purity from a concentrated hydrochloric acid solution of contaminated platinum containing base and noble metal impurities includes electrolyzing the hydrochloric acid solution containing the contaminated platinum in an electrolysis cell subdivided by a cation exchanger membrane under potentiostatic or voltage-controlled conditions with a voltage of 2.5 V to 8 V applied across the anode and cathode under a current density of 0.3 to 12.5 $A/dm^2$ so as to form a refined platinum-containing solution and a platinum alloy metal deposit. The concentrated hydrochloric acid solutions used in the process can have a contaminated platinum content of 50 to 700 g/l and total metal impurities of $\leqq 5000$ ppm. In contrast to the known prior art processes, the process according to the invention operates with minimal requirements in terms of safety technology and equipment, causes a minimal environmental burden and is far less time-consuming and more economical.

16 Claims, No Drawings

ELECTROLYTIC PROCESS FOR OBTAINING HIGH PURITY PLATINUM FROM CONTAMINATED PLATINUM

BACKGROUND OF THE INVENTION

The present invention relates to an electrolytic process for obtaining platinum of high purity from a concentrated hydrochloric acid solution of contaminated platinum.

Platinum used, for example in instruments, thermocouple elements and catalyzers, is contaminated with base and noble metal impurities after a certain time period depending on the nature of the production process concerned. Scrap platinum having a total metal impurity content of up to 5000 ppm is therefore regularly produced.

Prior to further use in many applications, this scrap platinum must be refined so as to provide, for example, platinum of 99.95% purity for instrument platinum or of 99.99% purity for thermocouple elements. In addition, depending on the intended use, specified quantities of certain impurities must be provided.

The refinement of contaminated platinum may occur by multiple precipitation of the platinum as ammonium platinum chloride.

$$Pt \rightarrow H_2[PtCl_6] \rightarrow (NH_4)_2[PtCl_{16}] \rightarrow Pt$$

This process, however, has the disadvantages of being very labor-intensive and time-consuming and has many opportunities for loss material. Moreover, the operational personnel are subject to a high allergy risk caused by the ammonium platinum chloride.

These disadvantages could be reduced by using the ion exchanger process according to the WP 147 688. Maximum concentrations of base and noble metals of up to 1000 ppm present as impurities in the platinum can be reduced according to this process, in which a single or multiple precipitation of ammonium platinum chloride is required as a further refinement step. The process can be shortened by a combination of solvent extraction and precipitation in the form of ammonium platinum chloride. Both processes, however, disadvantageously require elaborate equipment and control engineering.

Electrolytic processes for refining gold have been known for a long time (Gmelin Au, Syst. No. 62, 1949) and have been continuously developed further (EP 0 253 783).

From British Patent GB-PS 157 785 and German Published Patent Application 594 408, electrolytic platinum refinement processes are known, which partly operate with combinations of chemical and electrolytic process steps (U.S. Pat. No. 3,891,741).

These processes are all very time-consuming and cannot be reproduced in technically acceptable form in all aspects.

U.S. Pat. No. 4,382,845 describes a partial electrolytic separation of palladium from solutions containing an excess of palladium. Separation according to this process, however, is possible only up to the threshold at which platinum and palladium are present in equal quantities. The separation of further base and noble metals is not mentioned in this publication.

To separate platinum and palladium, a cation exchanger membrane is provided in tile electrolysis cell, whose advantages, however, are not apparent, since platinum and palladium can also be separated without a cation exchanger membrane in the concentration ratio specified and the described voltage range. In addition, this process has the same disadvantage as all other processes, since it can only be operated with a maximum concentration of ≦100 g/l.

SUMMARY OF THE INVENTION

It is an object of the present invention to provide a process for obtaining platinum of high purity, in which the noble and base metal impurities present are separated from contaminated platinum with minimum losses and with a minimum labor cost in a short period of time and without the need for elaborate equipment.

It was surprisingly found that platinum of high purity can be obtained from a platinum metal solution contaminated with base and noble metal impurities by electrolytic means.

According to the invention the electrolytic process for obtaining platinum of high purity from a concentrated hydrochloric solution of contaminated platinum including base and noble metals comprises electrolyzing the hydrochloric acid solution of the contaminated platinum, preferably a 6 to 8N hydrochloric acid solution, in an electrolysis cell having an anode and a cathode and subdivided by a cation exchanger membrane under potentiostatic or voltage-controlled conditions with a voltage of 2.5 V to 8 V applied across the anode and the cathode and a current density of 0.3 to 12.5 $A/dm^2$ to form a refined platinum-containing solution and a platinum alloy metal deposit; recovering the platinum alloy metal deposit and obtaining the high purity platinum from the refined platinum-containing solution.

In various embodiments of the method the platinum metal solution electrolyzed has a contaminated platinum content of 50 to 700 g/l and a total content of the metal impurities of ≦5000 ppm in relation to a total platinum metal content of the concentrated hydrochloric acid solution of the contaminated platinum.

Platinum metal solutions with a contaminated platinum content of 500 to 700 g/l are preferably used in the process according to the invention.

The base and noble metal impurities in the contaminated platinum can include at least one of the following elements: Rh, Pd, Ir, Au, Ag, Cu, Fe, Co, Ni, Sb, AS, Pb, Cd, Al, Mn, Mo, Si, Zn, Sn, Zr, W, Ti and Cr.

Hydrochloric acid platinum metal solutions, preferably hexachloroplatinic acid, can be used as the anolyte, and 6 to 8N hydrochloric acid, preferably 6N hydrochloric acid, can be used as the catholyte.

The anode can be made of platinum metal, while the cathode can be made of platinum metal, titanium or graphite.

The preferred cation exchanger membrane is a teflon membrane charged with sulfonic acid groups(Nafion R membrane).

The process according to the invention preferably occurs under potentiostatic or voltage-controlled conditions in the range of 4.5 V to 5 V and at a current density of 9 to 10 $A/dm^2$.

Platinum purities of 99.95% are obtainable from the hydrochloric acid solution having a contaminated platinum content of ≧300 g/l and total metal impurities of ≦5000 ppm, in one process step. By changing the anode and the anolyte, purification of up to a platinum purity of 99.99% is possible.

The process according to the invention can thus be performed in several steps, depending on the purity required of the platinum.

In the process according to the invention Ir, Rh and portions of the base metals and gold are first separated by using a hexachloroplatinic acid with a platinum metal content of 300 g/l in the anode compartment and using a 6N hydrochloric acid in the cathode compartment.

In the course of the electrolysis according to the invention the acid concentration drops as a result of the chlorine generation and the water transfer into the cathode compartment, while the volume of the anolyte and catholyte is maintained by the extraction of diluted hydrochloric acid from the cathode compartment and the addition of water in the anode compartment.

The complex bound ions dissociate, travel through the cation exchanger membrane and are deposited on the cathode. In addition to the separated noble and base metal impurities, the deposit still contains small quantities of Pt. This deposit is mechanically removed from the cathode and separately recovered.

The chlorine gas generated in the process according to the invention is removed by known methods.

In an apparatus having a capacity of 3 l respectively in the anode and the cathode compartment, 1 kg of platinum can be refined by the process according to the invention within 48 hours.

Within 20 h the following depletions of impurities are hereby obtained:

Cu (ppm)
1000→20
Fe (ppm)
136→16
Rh (ppm)
600→146
Ir (ppm)
980→500

The metallic platinum can be recovered from the solutions of the platinum metals refined by the process according to the invention by known electrolytic or chemical methods.

The process according to the invention provides the following advantages: it involves minimal requirements in terms of equipment and safety engineering; it causes minimal environmental burden; it is far less time-consuming and more economical than conventional processes.

The invention is now described in more detail by reference to several examples.

EXAMPLES

Example 1

A hydrochloric acid solution of contaminated platinum with the following noble and base metal impurities (ppm concentrations of impurities in relation to the total platinum present):

| | |
|---|---|
| Ir | 1020 ppm |
| Rh | 630 ppm |
| Pd | 440 ppm |
| Au | 120 ppm |
| Cu | 250 ppm |
| Fe | 280 ppm |
| Ni | 230 ppm |
| Sb | 100 ppm |
| Pb | 80 ppm |

-continued

| | |
|---|---|
| Al | 80 ppm |

and a platinum content of 250 g/l (pH-value ≦1) is electrolyzed in an electrolysis cell, whose cathode and anode compartments are subdivided by a cation exchanger membrane, with a voltage of 4.5 V across anode and cathode and a current density of 9 A/dm$^2$.

After 15 hours a reduction in the base metal concentrations to values ≦20 ppm is achieved. The iridium, rhodium and gold content has been reduced by 50% and the palladium content by 20%.

After an additional electrolysis step lasting 15 hours a reduction of the noble metal impurity concentrations to the following values is obtained:

Ir<200 ppm
Rh<50 ppm
Pd<200 ppm
Au<20 ppm

Example 2

The pre-refined solution of Example 1 is diluted to a platinum content of 120 g/l (pH-value 0.1) and transferred to another electrolysis cell also comprising a cation exchanger membrane and is then electrolyzed with an applied voltage of 5 V across anode and cathode and 10 A/dm$^2$. The analysis after an electrolysis period of 10 hours shows that the base metal contaminations and gold were reduced to values ≦10 ppm and the platinum metals were reduced to Ir<20 ppm
Rh<5 ppm
Pd<10 ppm

Example 3

The platinum solution refined according to Example 1 is left in the electrolysis cell and the catholyte is replaced by fresh 6N hydrochloric acid. The anolyte is diluted to a platinum content of 120 g/l. After an electrolysis period of 12 hours the purity level shown in Example 2 is achieved.

While the invention has been illustrated and described as embodied in an electrolytic process for obtaining high purity platinum from contaminated platinum, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is new and desired to be protected by Letters Patent is set forth in the appended claims.

We claim:

1. Electrolytic process for obtaining platinum having a high purity from a concentrated hydrochloric acid solution of contaminated platinum containing noble and base metal impurities, said process comprising the steps of:

a) providing an electrolysis cell comprising an anode compartment containing an anode and the concentrated hydrochloric acid solution of the contaminated platinum as anolyte and a cathode compartment containing a cathode and a 6 to 8N hydrochloric acid solution as catholyte, said anode compartment being divided from said cathode compartment in said electrolysis cell by a cation exchanger membrane;

b) electrolyzing said hydrochloric acid solution of said contaminated platinum in said electrolysis cell under voltage-controlled conditions by applying a voltage of from 2.5 V to 8 V across said anode and said cathode at a current density of from 0.3 to 12.5 $A/dm^2$ to form a refined platinum-containing solution and a platinum alloy metal deposit;

c) recovering said platinum alloy metal deposit; and d) obtaining said platinum of high purity from said refined platinum-containing solution.

2. Process according to claim 1, wherein said hydrochloric acid solution of said contaminated platinum has a contaminated platinum content of 50 to 700 g/l and a total content of said impurities of $\leqq$5000 ppm in relation to a total platinum metal content of the concentrated hydrochloric acid solution of the contaminated platinum.

3. Process according to claim 2, wherein said contaminated platinum content in said hydrochloric acid solution of said contaminated platinum is 500 to 700 g/l.

4. Process according to claim 1, wherein said metal impurities contain at least one element selected from the group consisting of Rh, Pd, Ir, Au, Ag, Cu, Fe, Co, Ni, Sb, As, Pb, Cd, Al, Mn, Mo, Si, Zn, Sn, Zr, W, Ti and Cr.

5. Process according to claim 1, wherein said anolyte comprises hexachloroplatinic acid.

6. Process according to claim 1, wherein said catholyte comprises said 6N hydrochloric acid solution.

7. Process according to claim 1, wherein said voltage applied across said anode and said cathode is from 4.5 v to 5 V and at a current density of 9 to 10 $A/dm^2$.

8. Process according to claim 1, further comprising controlling said voltage applied across said anode and cathode to generate chlorine gas during said electrolysis and removing said chlorine gas from said electrolysis cell.

9. Process according to claim 1, wherein said anode is made of platinum metal and said cathode is made from a material selected from the group consisting of platinum metal, titanium metal and graphite.

10. Process according to claim 1, wherein said cation exchanger membrane consists of a teflon membrane.

11. Process according to claim 1, wherein said platinum alloy metal deposit is formed on said cathode.

12. Process according to claim 11, wherein said recovering includes removing mechanically said platinum alloy metal deposit from the cathode.

13. Process according to claim 12, wherein said electrolysis is performed in a plurality of steps depending on a purity required of said platinum.

14. Process according to claim 1, wherein said obtaining said platinum of high purity from said refined platinum-containing solution occurs by electrolytic means.

15. Process according to claim 1, wherein said obtaining said platinum of high purity from said refined platinum-containing solution occurs by chemical means.

16. Process according to claim 1, wherein said voltage-controlled conditions consist of potentiostatic conditions.

* * * * *